US011808223B2

(12) United States Patent
Romeborn

(10) Patent No.: US 11,808,223 B2
(45) Date of Patent: Nov. 7, 2023

(54) METHOD AND A CONTROL SYSTEM FOR CONTROLLING AN INTERNAL COMBUSTION ENGINE

(71) Applicant: VOLVO PENTA CORPORATION, Gothenburg (SE)

(72) Inventor: Magnus Romeborn, Björketorp (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 40 days.

(21) Appl. No.: 17/441,176

(22) PCT Filed: Mar. 20, 2019

(86) PCT No.: PCT/EP2019/056984
§ 371 (c)(1),
(2) Date: Sep. 20, 2021

(87) PCT Pub. No.: WO2020/187415
PCT Pub. Date: Sep. 24, 2020

(65) Prior Publication Data

US 2022/0163003 A1 May 26, 2022

(51) Int. Cl.
*F02D 35/00* (2006.01)
*F02D 41/00* (2006.01)
*F02D 41/02* (2006.01)

(52) U.S. Cl.
CPC ..... *F02D 35/0092* (2013.01); *F02D 41/008* (2013.01); *F02D 41/0245* (2013.01); *F02D 2200/08* (2013.01)

(58) Field of Classification Search
CPC ..... F02D 35/0092; F02D 41/008; F02D 41/0245; F02D 2200/08; F02D 41/0275;
(Continued)

(56) References Cited

U.S. PATENT DOCUMENTS 4,641,613 A * 2/1987 Delesalle ..... F02D 41/3058 123/90.11
5,661,971 A 9/1997 Waschatz et al.
(Continued)

FOREIGN PATENT DOCUMENTS

AU 467352 B2 11/1975
CN 106285985 A 1/2017
(Continued)

OTHER PUBLICATIONS

International Search Report and Written Opinion dated Nov. 20, 2019 in corresponding International PCT Application No. PCT/EP2019/056984, 10 pages.
(Continued)

*Primary Examiner* — Logan M Kraft
*Assistant Examiner* — Susan E Scharpf
(74) *Attorney, Agent, or Firm* — Venable LLP; Jeffri A. Kaminski

(57) ABSTRACT

The invention relates to a method to heat exhaust gases to a selected specific temperature by fuel injection control in an internal combustion engine (112), which engine comprises a control unit (115) registering the currently requested load and determining a required fuel amount in response to the requested load. The method involves registering low load operation of the internal combustion engine; registering an input from at least one exhaust after-treatment system (121) sensor indicating a detected condition; determining an exhaust temperature requirement for the detected condition and calculating a target exhaust temperature; selecting a group of cylinders to be regulated for achieving the target exhaust temperature; calculating a ratio for desired $1^{st}$ and $2^{nd}$ fuel amounts to be injected alternately in consecutive induction strokes for the selected group of cylinders to achieve the target exhaust temperature; wherein the ratio
(Continued)

defines an offset between an increased $1^{st}$ fuel amount to be injected in a cylinder of the selected group of cylinders for every second induction stroke, and a reduced $2^{nd}$ fuel amount to be injected for the intermediate induction strokes.

14 Claims, 8 Drawing Sheets

(58) Field of Classification Search
CPC .. F02D 41/029; F02D 41/025; F02D 41/0255; F02D 41/1408; F02D 41/30; F02D 41/024
See application file for complete search history.

(56) References Cited

U.S. PATENT DOCUMENTS

2003/0089102 A1* 5/2003 Colignon ..... F01N 3/035 60/286
2004/0187480 A1 9/2004 Bidner et al.
2008/0060609 A1* 3/2008 Surnilla ..... F02D 41/3058 123/90.15
2015/0300245 A1* 10/2015 Korenaga ..... F02D 41/0007 60/603
2015/0308364 A1* 10/2015 Hojo ..... F01N 9/00 60/285
2018/0238258 A1 8/2018 Nakamura et al.
2019/0048816 A1 2/2019 Nose et al.

FOREIGN PATENT DOCUMENTS

CN 109209569 A 1/2019
DE 102006023693 A1 11/2007
DE 102016110632 A1 12/2017
EP 1310656 A1 5/2003
EP 1561015 A1 8/2005
GB 201215719 A 3/2014
JP 2007198339 A 8/2007
JP 2008019792 A 1/2008
JP 2010024990 A 2/2010
JP 2012057492 A 3/2012
WO 2006115158 A1 11/2006

OTHER PUBLICATIONS

Chinese Office Action dated May 20, 2023 in corresponding Chinese Patent Application No. 201980094322.8, 21 pages.

* cited by examiner

METHOD AND A CONTROL SYSTEM FOR CONTROLLING AN INTERNAL COMBUSTION ENGINE

CROSS-REFERENCE TO RELATED APPLICATIONS

This application is a U.S. National Stage application of PCT/EP2019/056984, filed Mar. 20, 2019, and published on Sep. 24, 2020, as WO 2020/187415 A1, all of which is hereby incorporated by reference in its entirety.

TECHNICAL FIELD

The invention relates to a method and a control system for controlling an internal combustion engine in a vehicle.

The invention can be applied in heavy-duty vehicles, such as trucks, articulated trucks, buses and construction equipment, which vehicles may be manned or driven autonomously. Although the invention will be described with respect to a heavy-duty land vehicle, the invention is not restricted to this particular vehicle, but may also be used in other vehicles such as buses, articulated haulers, wheel loaders and other working machines or marine vessels comprising an internal combustion engine with an exhaust after-treatment system.

BACKGROUND

In some internal combustion engine (ICE) applications the exhaust after-treatment system (EATS) can experience problems during long periods with idle and/or low load operation. Under such conditions, an EATS comprising a diesel particulate filter (DPF) and a selective catalytic reduction (SCR) unit, also termed catalytic converter, can experience problems due to relatively low exhaust temperatures.

During cold start operation, a common strategy is to operate the engine using a rich air-fuel mixture until the EATS reaches its operational temperature, or light-off. However, this mode of operation has a detrimental effect on fuel consumption and engine emissions.

During low load operation the exhaust temperature can be reduced below the temperature required for operating the SCR unit, and for regenerating the DPF. This can be a problem for the DPF, as an over-filled filter increases the back pressure in the exhaust system and can trigger a "limp-home" function that limits the output of the engine. Also, an over-filled particulate filter that can no longer be regenerated must either be removed for cleaning or be replaced. One way of overcoming this problem is to perform regular and time-consuming parked regeneration. This requires the vehicle to be stationary during the regeneration process and results in increased fuel consumption as well as down time for the vehicle owner. In addition, frequent regeneration cycles can also reduce the lifetime of the DPF and the SCR unit.

An alternative way of overcoming this problem is to use hot exhaust gas recirculation (EGR) and intake air throttling of the engine, which is costly in terms of fuel consumption and emissions. When a clogged DPF is detected, an engine control unit (ECU) activates a regeneration process to increase the DPF temperature to a desired level. The engine is then set for EGR operation and up to eight times more fuel per stroke can be injected to produce a high amount of $NO_2$, which will help oxidize the particulates in the DPF, and to increase the temperature as the exhaust gases pass through the DPF and the SCR unit.

The invention provides an improved method and a control system for controlling an ICE, in order to maintain the functionality of the EATS, and aims to solve the above-mentioned problems

SUMMARY

An object of the invention is to provide a method and a control system for controlling an ICE, which solves the above-mentioned problems.

The object is achieved by a method according to claim 1.

In the subsequent text, the abbreviations ICE, EATS, DPF and SCR as indicated above will be used in the subsequent text. The term "engine control unit" is referred to as an ECU or "control unit". The engine control unit is an electronic controller connected to sensors measuring a number of variables required for controlling and/or monitoring the operation of the ICE. Only the measured variables required for performing the method according to the invention will be described in the appended text. The engine control unit is able to initiate and control engine operation by means of various electrical, hydraulic and/or pneumatic actuators in response to detected engine conditions.

A conventional exhaust after-treatment system or EATS comprises a DPF unit arranged downstream of an ICE, a SCR unit arranged downstream of said DPF unit, and an injector for feeding reducing agent, e.g. urea, into the exhaust gas immediately upstream of the SCR unit. The EATS can also comprise a $NO_2$ reduction catalyst, such as a diesel oxygen catalyst (DOC) arranged upstream of the DPF, or downstream of the DPF unit and upstream of the SCR unit. A further injector can be provided for feeding a reducing agent, e.g. fuel, into the exhaust gas upstream of said $NO_2$ reduction catalyst. The DOC provides NO- and HC-oxidation of the exhaust gas prior to the SCR and can control the supply of $NO_2$ to the SCR unit. The above terms will be adhered to in the subsequent text.

According to one aspect of the invention, the object is achieved by means of a method performed in order to maintain the functionality of the EATS. The method involves heating exhaust gases to a selected specific temperature by fuel injection control in an internal combustion engine (ICE) operated in a four stroke cycle, which ICE comprises a control unit registering the currently requested load and determining a required fuel amount in response to the requested load.

The method involves performing the steps of:

- registering low load operation of the internal combustion engine;
- registering an input from at least one exhaust after-treatment system (EATS) sensor indicating a detected predetermined condition;
- determining an exhaust temperature requirement for the detected condition and calculating a target exhaust temperature;
- selecting a group of cylinders to be regulated for achieving the target exhaust temperature;
- calculating a ratio for desired $1^{st}$ and $2^{nd}$ fuel amounts to be injected alternately in consecutive induction strokes for the selected group of cylinders to achieve the target exhaust temperature;

wherein the ratio defines an offset between an increased $1^{st}$ fuel amount to be injected in a cylinder of the selected group of cylinders for every second induction stroke, and a reduced $2^{nd}$ fuel amount to be injected for the intermediate induction strokes.

The initial step involves monitoring and registering whether or not the internal combustion engine is operated at low load, that is, idling or operated at low speed and low load. When a low load operation is registered, the method proceeds to check if it has been registered that a predetermined condition has been detected in the EATS. A non-exhaustive list of examples of such conditions comprises detecting that back-pressure in the manifold or a pressure drop across the DPF unit has exceeded a predetermined limit, indicating that a regeneration of the DPF unit is required. A further condition is that the temperature of the exhaust leaving the engine or the temperature in any one of the EATS units has dropped below a desired value. Alternatively, it can be detected that a measured temperature is dropping at a rate that is higher than expected or desired.

Depending on the detected condition, the ECU can determine an exhaust temperature requirement for the detected condition and calculates a target exhaust temperature. The value of the calculated target exhaust temperature is dependent on the condition that must be corrected. Typically, an exhaust temperature required for regenerating the DPF unit is higher than the exhaust temperature required for operating the SCR unit.

The ECU can then select a group of cylinders from the total number of cylinders to be regulated for achieving the target exhaust temperature. A relatively small temperature increase can require a group numbering less than half of the available cylinders, while a larger temperature increase can require a group numbering at least half of the available cylinders. According to the invention, the selected group of cylinder cannot include all the available cylinders. The selected group of cylinders is preferably distributed evenly over the firing order sequence of the engine.

In the case of a V6 engine, the engine has two banks of cylinders where the respective banks are numbered 1-3 and 4-6 in consecutive order. The firing order is 1-5-3-6-2-4. For instance, if two out of six cylinders in a V6-engine are used, then cylinders 1 and 6 are regulated while cylinders 2, 3, 4 and 5 are operated normally at the currently requested load. Similarly, if three out of six cylinders in a V6-engine are used, then cylinders 1, 2 and 3 are regulated while cylinders 4, 5 and 6 are operated normally at the currently requested load. A similar cylinder distribution can be used for both in-line and V-type engines. If four out of six cylinders in a V6-engine are used, then cylinders 1, 2, 5 and 6 are regulated while cylinders 3 and 4 are operated normally at the currently requested load. A similar cylinder distribution can be used for both in-line and V-type engines. The above examples should only be considered to be non-limiting, as the group of cylinders can be selected freely within the scope of the invention, It should be noted, in this and any subsequent example, that non-selected cylinders are operated normally at the currently requested load. This can entail that the power output of these cylinder will need to be increased, depending on the regulation of the selected group of cylinders. For instance, when the target exhaust temperature is relatively high, then the ratio defining the offset between an increased $1^{st}$ fuel amount and a reduced 2nd fuel amount will be relatively large. If the $2^{nd}$ fuel amount has been reduced to zero, then the power output in the subsequent power stroke will also be zero. Further, the $1^{st}$ fuel amount will at this point comprise at least twice the fuel amount for the requested load. This will result in an incomplete combustion in the subsequent power stroke and a significantly reduced power output. Hence, the non-selected cylinders will be controlled to compensate for this loss of power output and to maintain engine operation at the requested load. Non-combusted fuel from the regulated cylinders will oxidize in the exhaust manifold, causing the increase in exhaust temperature and pressure required for achieving the target exhaust temperature.

The ECU will also calculate a ratio for desired $1^{st}$ and $2^{nd}$ fuel amounts to be injected alternately in consecutive induction strokes for the selected group of cylinders to achieve the target exhaust temperature. By increasing the $1^{st}$ fuel amount to be injected in one regulated cylinder of the selected group of cylinders and reducing $2^{nd}$ fuel amount to be injected for the intermediate induction stroke in a subsequent regulated cylinder, the exhaust leaving the engine is heated towards the target exhaust temperature.

Using the examples outlined above, if two out of six cylinders in a V6-engine are used, then cylinders 1 and 6 are regulated while cylinders 2, 3, 4 and 5 are operated normally at the currently requested load. In this case, the increased $1^{st}$ fuel amount would be injected in cylinder 1, while the reduced $2^{nd}$ fuel amount would be injected in cylinder 6. Thus, cylinder 1 will continuously receive the increased fuel amounts and cylinder 6 will continuously receive the decreased fuel amounts.

On the other hand, if three out of six cylinders in a V6-engine are used, then cylinders 1, 2 and 3 are regulated while cylinders 4, 5 and 6 are operated normally at the currently requested load. In this case, the increased $1^{st}$ fuel amount would be injected in cylinder 1, while the reduced $2^{nd}$ fuel amount would be injected in cylinder 2. The subsequent increased $1^{st}$ fuel amount would be injected in cylinder 3, while the subsequent reduced $2^{nd}$ fuel amount would be injected in cylinder 1, and so on. Hence, the distribution of the increased and the decreased fuel amounts will follow the firing order of the regulated cylinders 1-3.

In accordance with the invention, the cylinders not selected for regulation are instead operated normally at the currently requested load. The amount of fuel injected for the requested load is either determined by the ECU, in the case of idling, or by the driver controlling an accelerator pedal or similar engine control means, in the case of low load operation for a vehicle in motion. An advantage of this operation is that the normally operated cylinders will assist the engine in running smoothly, in particular when reduced $2^{nd}$ fuel amount approaches zero.

According to one example, the method involves monitoring the exhaust temperature using available sensors and adjusting the ratio for the desired $1^{st}$ and $2^{nd}$ fuel amounts to be injected in order to achieve the target exhaust temperature. The amount of heat delivered to the EATS can thereby be regulated by controlling the relative difference in volume between the $1^{st}$ and $2^{nd}$ fuel amounts to be injected.

According to a further example, the method involves monitoring the exhaust temperature and adjusting the number of selected cylinders to be regulated for achieving the target exhaust temperature. The amount of heat delivered to the EATS can thereby be regulated by increasing or reducing the number of selected cylinders to be regulated.

According to a further example the exhaust temperature can be regulated by a combination of regulating the relative difference in volume between the $1^{st}$ and $2^{nd}$ fuel amounts to be injected and increasing and reducing the number of selected cylinders to be regulated.

The strategy selected for controlling the exhaust temperature can vary depending on the detected condition, the operating state of the vehicle or the ICE, or on other factors such as ambient conditions. Examples of ambient conditions can be air temperature, humidity or atmospheric pressure.

According to one example, the ECU can detect that the DPF unit is within its desired operating parameters, but that the exhaust temperature is insufficient for maintaining the SCR unit at a desired temperature. In response the ECU checks whether the vehicle is operated at low load, and if so, calculates a target exhaust temperature and selects a group of cylinders based on stored values, a look-up table or similar. The ECU will then control the ICE according to the inventive method until the target exhaust temperature is achieved. If the ECU detects that the target exhaust temperature cannot be achieved, then the ratio for the $1^{st}$ and $2^{nd}$ fuel amounts to be injected is corrected and/or the number of cylinders in the selected group is increased.

The ICE is controlled in this way until the target exhaust temperature is achieved or until it is detected that low load operation is interrupted.

As indicated above, a ratio is calculated for the desired $1^{st}$ and $2^{nd}$ fuel amounts to be injected alternately in consecutive induction strokes for the selected group of cylinders. Particularly, an increase of the $1^{st}$ fuel amount is balanced by a corresponding reduction of the $2^{nd}$ fuel amount. The $1^{st}$ fuel amount can be increased to an amount up to or in excess of the combined $1^{st}$ fuel amount and $2^{nd}$ fuel amount when the $2^{nd}$ fuel amount is reduced to zero. According to an alternative example, the $1^{st}$ fuel amount can be increased up to 130% of the combined $1^{st}$ fuel amount and $2^{nd}$ fuel amount when the $2^{nd}$ fuel amount is reduced to zero. The latter increase can be used to compensate for the friction losses in cylinders not producing a positive torque output.

According to the invention, the ratio calculated for the desired $1^{st}$ fuel amount and $2^{nd}$ fuel amount increases with an increased exhaust temperature requirement. In this way, the offset defined by said ratio changes so that an increased $1^{st}$ fuel amount is balanced by a corresponding reduction of the $2^{nd}$ fuel amount until the $2^{nd}$ fuel amount reaches zero. When calculating the ratio between the desired $1^{st}$ fuel amount and $2^{nd}$ fuel amount in all the above examples, the starting point is that both fuel amounts are equal to the required fuel amount in response to the requested load at the time the regulation is started.

According to a second aspect, the invention relates to a control system to heat exhaust gases to a selected specific temperature by fuel injection control wherein the control system is operated using the method as described above.

According to a second aspect, the invention relates to a computer program comprising program code means for performing all the steps of the method as described above when said program is run on a computer.

According to a second aspect, the invention relates to a computer program product comprising program code means stored on a computer readable medium for performing all steps of anyone of the method as described above when said program product is run on a computer.

An advantage of the method of operation described above is that the exhaust temperature can be balanced to a specific target exhaust temperature and keep the DPF and SCR working during low load operation of the ICE. This mode of operation will also reduce the fuel consumption and the emissions during low load and idle operation. During a cold start, an effect of the method is that the time for the SCR to become operational is reduced. The described function will also minimize or prevent parked regeneration, which is an undesirable and time consuming event for the driver. Reducing the number of parked regeneration will also increase the life time for DPF and SCR. A side effect of the method is that the higher exhaust temperature provided by the operating mode can be used to heat the cabin, which reduces the need for an external heater.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
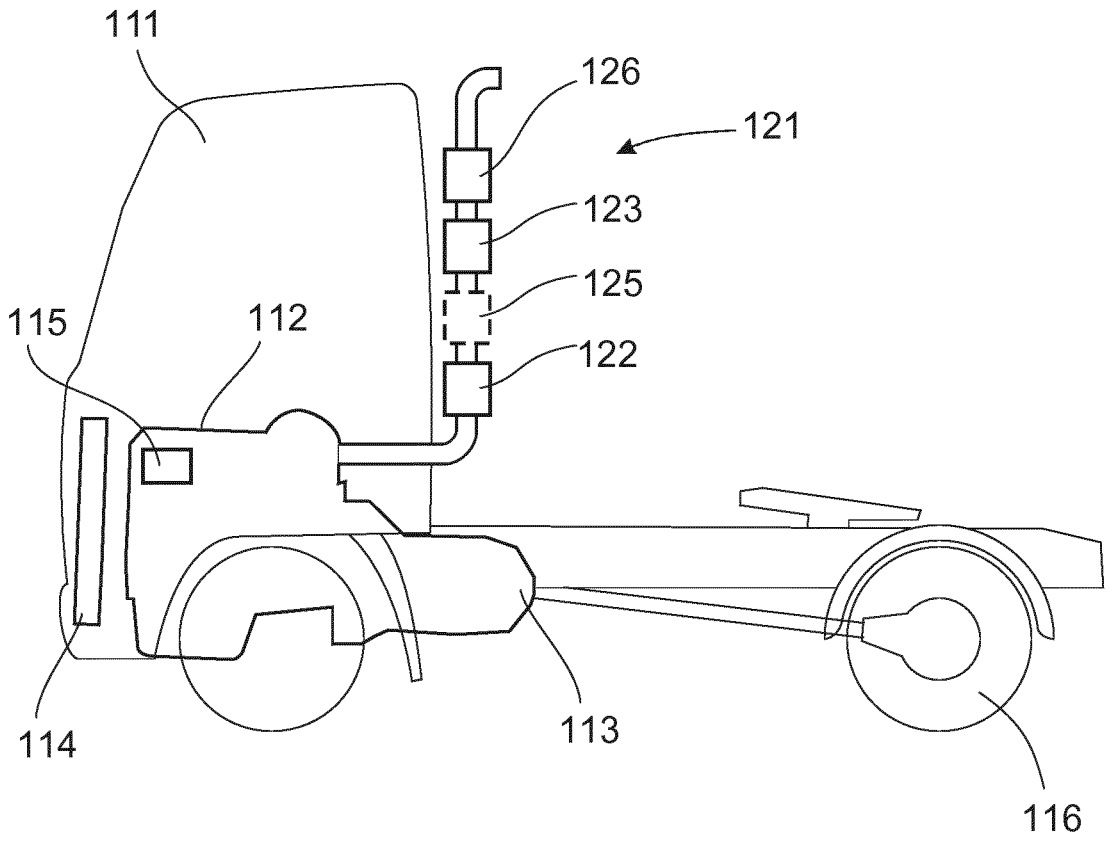
FIG. 1 shows a schematically indicated vehicle comprising an internal combustion engine (ICE) operable according to the invention.

FIG. 1 shows a side view of a schematically indicated vehicle 111 comprising an internal combustion engine (ICE) 112 connected to a transmission 113, such as an automated manual transmission (AMT), for transmitting torque to a pair of driven wheels 116 driven by a rear drive axle (not shown). The ICE 112 is connected to a cooling arrangement 114 for cooling engine coolant, oil and exhaust gas in an exhaust gas recirculation (EGR) system (not shown) from the ICE 112. The ICE 112 is further connected to an exhaust after-treatment system or EATS 121 located in an exhaust conduit extending between an exhaust manifold and a silencer unit 126. The EATS 121 comprises a DPF unit 122 arranged downstream of the ICE, a SCR 123 unit arranged downstream of said DPF unit. The DPF unit 122 is provided with an injector (not shown) for feeding reducing agent, e.g. urea, into the exhaust gas immediately upstream of the SCR unit 123. The EATS can also comprise an optional $NO_2$ reduction catalyst 125 (indicated in dashed lines), such as a diesel oxygen catalyst (DOC). In FIG. 1 the optional $NO_2$ reduction catalyst 125 is arranged downstream of the DPF unit 121 and upstream of the SCR unit 122, but it can alternatively be arranged upstream or downstream of the DPF unit. Note that the location of the EATS 121 is only schematically indicated in FIG. 1. The ICE 112 is controlled by the driver or automatically via an engine control unit (ECU) 115, e,g, during engine idling. The ECU 115 is provided with control algorithms for controlling the ICE 112 independently or in response to a throttle pedal input requested by the driver. The ICE 112 is further controlled by the ECU 115 in response to input signals from multiple sensors (see FIG. 2) in the EATS 121.

Figure 2:
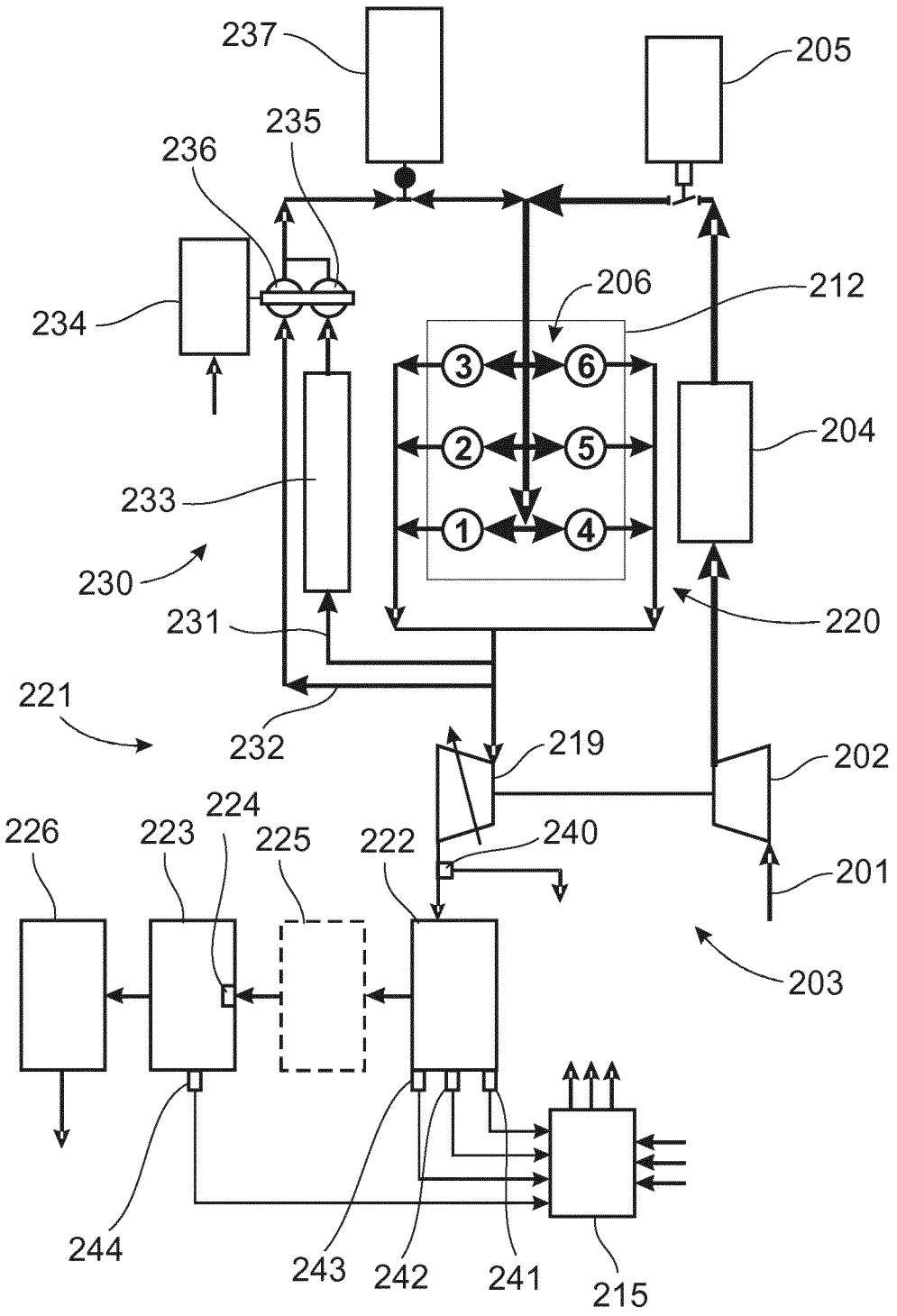
FIG. 2 shows a schematically indicated ICE operable according to the invention.

FIG. 2 shows a schematically indicated ICE 212 arranged to perform the method according to the invention. The ICE 212 has an intake air conduit comprising an air intake 201 for ambient air, which ambient air passes through a compressor unit 202, that is part of a turbo charger unit 203. Pressurized intake air is supplied to a charge air cooling (CAC) unit 204 and a controllable throttle unit 205 into an intake air manifold 206 connected to the ICE 212. In this example the ICE 212 is a V6 engine having two banks of cylinders where the respective cylinder banks are numbered 1-3 and 4-6 in consecutive order. The firing order in this case is 1-5-3-6-2-4. The ICE 212 further has an exhaust gas conduit comprising an exhaust manifold 220 connected to the ICE 212, a turbine unit 219 and an exhaust after-treatment system or EATS 221 located in the exhaust conduit between the turbine unit 219 and a silencer unit 226. The EATS 221 comprises a DPF unit 222 arranged downstream of the ICE 212, a SCR 223 unit arranged downstream of said DPF unit, and an injector 224 for feeding reducing agent into the exhaust gas immediately upstream of the SCR unit 223. The EATS can also comprise an optional $NO_2$ reduction catalyst 225 (indicated in dashed lines), such as a diesel oxygen catalyst (DOC) arranged downstream of the DPF unit 221 and upstream of the SCR unit 222.

The ICE 212 is further connected to an exhaust gas recirculation (EGR) system 230, arranged to return exhaust gas from the exhaust manifold 220 to the intake air manifold 206. The (EGR) system 230 comprises a first conduit 231 and a second conduit 232, wherein the first conduit leads to controllable valve 234 via a cooling arrangement 233 for cooling recirculated exhaust gas. The second conduit 232 is a bypass conduit leading past cooling arrangement 233 directly to the controllable valve 234. The controllable valve 234 is operated by an ECU 215 to selectively open a first valve 235 or a second valve 236, in order to supply recirculated exhaust gas from the first conduit 231 or the second conduit 232, respectively, to the air intake manifold 206, vial a flow modulating unit 237 that regulates the amount of recirculated exhaust gas supplied to the air intake manifold 206.

The ICE 212 is controlled by the driver or automatically via an engine control unit (ECU) 215, e,g, during engine idling. The ECU 215 is provided with control algorithms for controlling the ICE 212 independently or in response to a throttle pedal input requested by the driver. The ICE 212 is further controlled by the ECU 215, which issues commands to a number of actuators in response to input signals from multiple sensors detecting ICE and EATS related parameters. A non-exhaustive list of monitored ICE related parameters comprises intake air temperature, CAC temperature, engine coolant temperature, intake manifold pressure, throttle sensor, fuel injector pressure, EGR cooler temperature, EGR gas pressure, etc. Similarly, monitored EATS related parameters can comprise exhaust manifold pressure, DPF inlet and/or outlet pressure, DPF temperature, SCR pressure, SCR temperature, exhaust NH3-/NOx-/O2-levels, etc. In response to input from the sensor indicated above, the ECU issues commands to actuators controlling intake air flow rate, fuel injection volume and timing, intake and exhaust valve timing, EGR flow rate, etc. Standard operation of a compression ignition engine is considered to be well known and will not be discussed in further detail here.

In operation, the ICE 212 can be controlled in accordance with the invention to perform a method in order to maintain the functionality of the EATS 221. The method involves heating exhaust gases leaving the ICE to a selected specific temperature by fuel injection control, wherein the ECU 215 initially registers the currently requested load and determines a required fuel amount in response to the requested load.

The method involves registering that the ICE 212 is currently being operated in a low load condition, that is, the ICE is idling or operated at low speed and at a low load. To register low load operation, an idle signal indicating no driving torque request or accelerator pedal actuation can be used during idle. Low load operation above idling speed can be registered using a signal indicating a low driving torque request from the driver or that an acelerator pedal actuation is below a predetermined angle at current engine load. The ECU 215 then registers an input from at least one EATS sensor indicating a detected predetermined condition. EATS sensor signals can be received, for example, from an exhaust temperature sensor 240 downstream of the turbocharger turbine unit 219, pressure sensors 241, 243 at the inlet and outlet of the DPF unit 222, a DPF temperature sensor 242 and a SCR temperature sensor 244. The detected predetermined condition can be that the pressure difference across the DPF unit 222 has exceeded a desired value, indicating that a regeneration sequence is required to burn off and remove collected particles. Alternatively, the predetermined condition can be that the SCR temperature is being reduced at a rate exceeding a desired rate, or that the SCR temperature is below the operating temperature of the SCR unit 223.

When such a predetermined condition is detected, the ECU 215 determines an exhaust temperature requirement for the detected condition and calculates a target exhaust temperature. The target exhaust temperature, as the operating temperature for the SCR unit 223 is in the range 250-450° C., depending on e.g. the catalyst material, while the temperature required for regenerating the DPF unit 222 can be in excess of 600° C. Depending on the required target exhaust temperature, the ECU 215 selects a group of cylinders to be regulated for achieving this temperature. The number of cylinders can be selected from a table of stored values giving a minimum number of cylinders suitable for achieving the target exhaust temperature. The number of cylinders selected will increase with an increase in target temperature. For instance, a relatively small temperature increase for the SCR unit can require a group numbering less than half of the available cylinders, while a larger temperature increase for regeneration of the DPF unit can require a group numbering at least half of the available cylinders. According to the invention, the selected group of cylinder cannot include all the available cylinders. The selected group of cylinders is preferably distributed evenly over the firing order sequence of the engine.

The ECU 215 then calculates a ratio for desired $1^{st}$ and $2^{nd}$ fuel amounts to be injected alternately in consecutive induction strokes for the selected group of cylinders to achieve the target exhaust temperature. The ratio defines an offset between an increased $1^{st}$ fuel amount to be injected in a cylinder of the selected group of cylinders for every second induction stroke, and a reduced $2^{nd}$ fuel amount to be injected for the intermediate induction strokes. The initial ratio can be calculated or be selected from a table of stored values giving a minimum ratio suitable for achieving the target exhaust temperature. By monitoring the exhaust temperature, the ECU 215 can then recalculate and correct the ratio to increase or decrease the exhaust temperature. Increasing the ratio will cause a further increase of the $1^{st}$ fuel amount and a simultaneous, corresponding reduction of the $2^{nd}$ fuel amount, as well as an increase in the mass flow of exhaust gas, resulting in an increased exhaust temperature.

Figure 3:
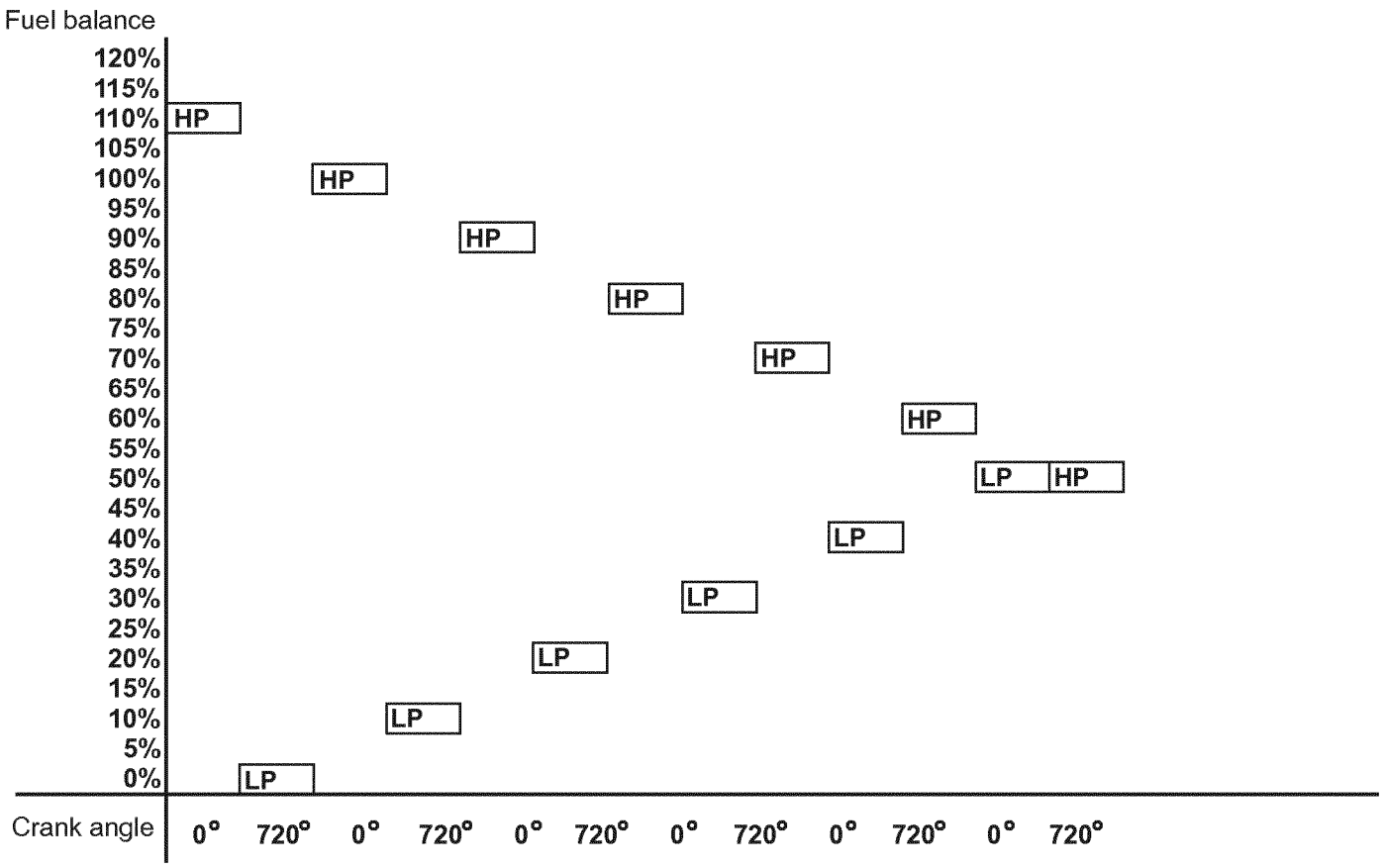
FIG. 3 shows a schematic diagram illustrating the variation in injected fuel ratio for a single cylinder.

FIG. 3 shows a schematic diagram illustrating the possible variation in injected fuel ratio for a single cylinder. As described above, the ECU will calculate a ratio for desired $1^{st}$ and $2^{nd}$ fuel amounts to be injected alternately in consecutive induction strokes to achieve a target exhaust temperature. Starting at the right-hand side of the diagram, the ratio is 1/1 and the cylinder is operating normally with the requested fuel amount for the current load being injected every 720 crank angle degrees (CAD) as shown on the x-axis. At this time there is no offset between the fuel amounts and the fuel balance is 50/50 as indicated on the y-axis. By increasing the $1^{st}$ fuel amount to be injected in the regulated cylinder, indicated by "HP" in the diagram, and reducing $2^{nd}$ fuel amount to be injected for the consecutive induction stroke, indicated by "LP" in the diagram, the exhaust leaving the cylinder is heated towards the target exhaust temperature. Moving towards the left in the diagram, an increase of the $1^{st}$ fuel amount HP is balanced by a corresponding reduction of subsequent the $2^{nd}$ fuel amount LP as the offset between the fuel amounts increases.

If required to reach the target exhaust temperature, the regulation of the ratio can continue until the $1^{st}$ fuel amount can be increased to an amount up to or in excess of the combined $1^{st}$ fuel amount and $2^{nd}$ fuel amount when the $2^{nd}$ fuel amount is reduced to zero. At the time when the $2^{nd}$ fuel amount reaches zero the fuel balance is 100/0, so that the cylinder is alternating between a power stroke at lambda 0.5 and skipping a power stroke. If required, the reduction of torque output can be compensated for by increasing the $1^{st}$ fuel amount up to 130% of the initial combined $1^{st}$ fuel amount and $2^{nd}$ fuel amount when the $2^{nd}$ fuel amount is reduced to zero. This can be used to compensate for the friction and pumping losses when the cylinder is not producing a positive torque output.

Figure 4:
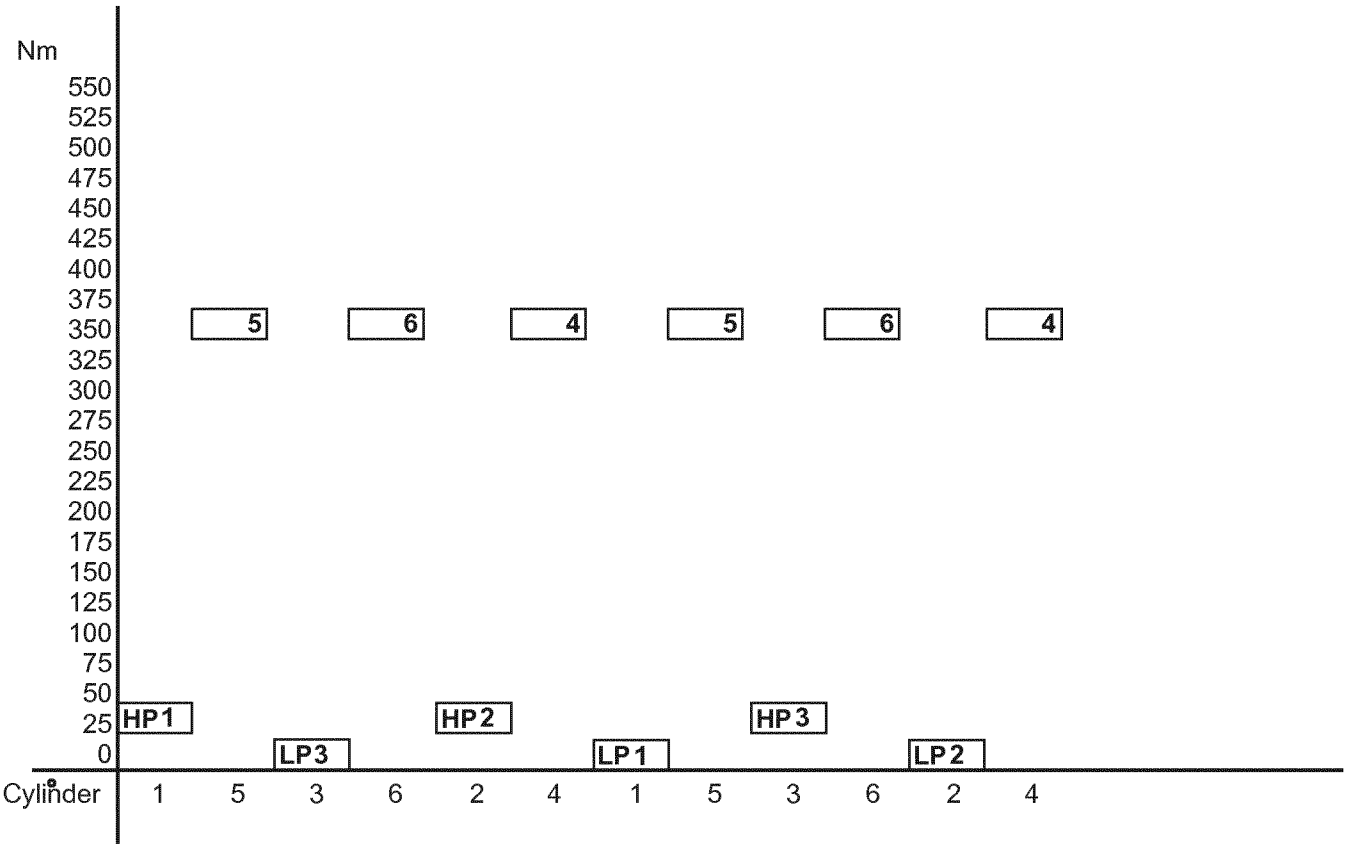
FIG. 4 shows a schematic diagram illustrating engine operation for heating a SCR unit.

FIG. 4 shows a schematic diagram illustrating engine operation for heating a SCR unit. As described above, the exhaust temperature can be reduced towards or below the temperature required for operating the SCR unit. This can, for example, occur during low load operation when the engine is idling.

The current example relates to a V6-engine having two banks of cylinders where the respective banks are numbered 1-3 and 4-6 in consecutive order, as shown in FIG. 2. The firing order for this engine is 1-5-3-6-2-4. After detecting that the engine is idling, the ECU has detected that the DPF unit is within its desired operating parameters, but that the exhaust temperature is insufficient for maintaining the SCR unit at a desired operating temperature. While monitoring that the vehicle is operated at low load, the ECU calculates a target exhaust temperature and selects a group of cylinders based on stored values, a look-up table or similar. In this example, three out of six cylinders in the V6-engine are used, wherein cylinders 1, 2 and 3 are regulated while cylinders 4, 5 and 6 are operated normally at the currently requested load, i.e. idling. The ECU will then control the ICE by controlling the $1^{st}$ and $2^{nd}$ fuel amounts until the target exhaust temperature is achieved. This is illustrated in FIG. 4, where the firing order is shown on the x-axis and the output torque (Nm) is shown on the y-axis. Consequently, the regulated cylinders 1, 2 and 3 are operated so that the calculated $1^{st}$ and $2^{nd}$ fuel amounts are injected alternately in consecutive induction strokes for the selected group of cylinders to achieve the target exhaust temperature. In this case, the increased $1^{st}$ fuel amount would be injected in cylinder 1, while the reduced $2^{nd}$ fuel amount would be injected in cylinder 2. The subsequent increased $1^{st}$ fuel amount would be injected in cylinder 3, while the subsequent reduced $2^{nd}$ fuel amount would be injected in cylinder 1, and so on. Hence, the distribution of the increased and the decreased fuel amounts will follow the firing order of the regulated cylinders 1-3. From FIG. 4 it can be seen that the current fuel balance is at least 100/0, wherein the increased $1^{st}$ fuel amount produces a power output of 12.5 Nm per combustion stroke while the $2^{nd}$ fuel amount has been reduced to zero. The non-regulated cylinders 4, 5 and 6 are controlled to maintain engine operation at the requested low load. The reduction in torque output from cylinders 1-3 requires an increase of the fuel injection to cylinders 4-6, so that each produces a power output of 350 Nm per combustion stroke. This can be compared to the power output for normal idling with all cylinders operated with the same fuel amounts, wherein each cylinder produces 90 Nm. The ICE is controlled in this way until the target exhaust temperature is achieved or until it is detected that low load operation is interrupted.

If necessary due to e.g. low ambient temperatures, the ICE can adjust the exhaust temperature by controlling the $1^{st}$ and $2^{nd}$ fuel amounts up or down to achieve the target exhaust temperature. The ECU will monitor the exhaust temperature during the adjustment of the fuel amounts. If the ECU detects that the target exhaust temperature cannot be achieved at the maximum ratio for the $1^{st}$ and $2^{nd}$ fuel amounts, then the number of cylinders in the selected group is increased. Consequently, when ratio for the $1^{st}$ and $2^{nd}$ fuel amounts has reached its maximum value and the ECU detects that the exhaust temperature is no longer increasing towards the target exhaust temperature, then the ECU can adjust the number of cylinders in the selected group. Based on stored values and the current difference between the exhaust temperature and the target exhaust temperature, the number selected cylinders is increased by at least one.

Figure 5A:
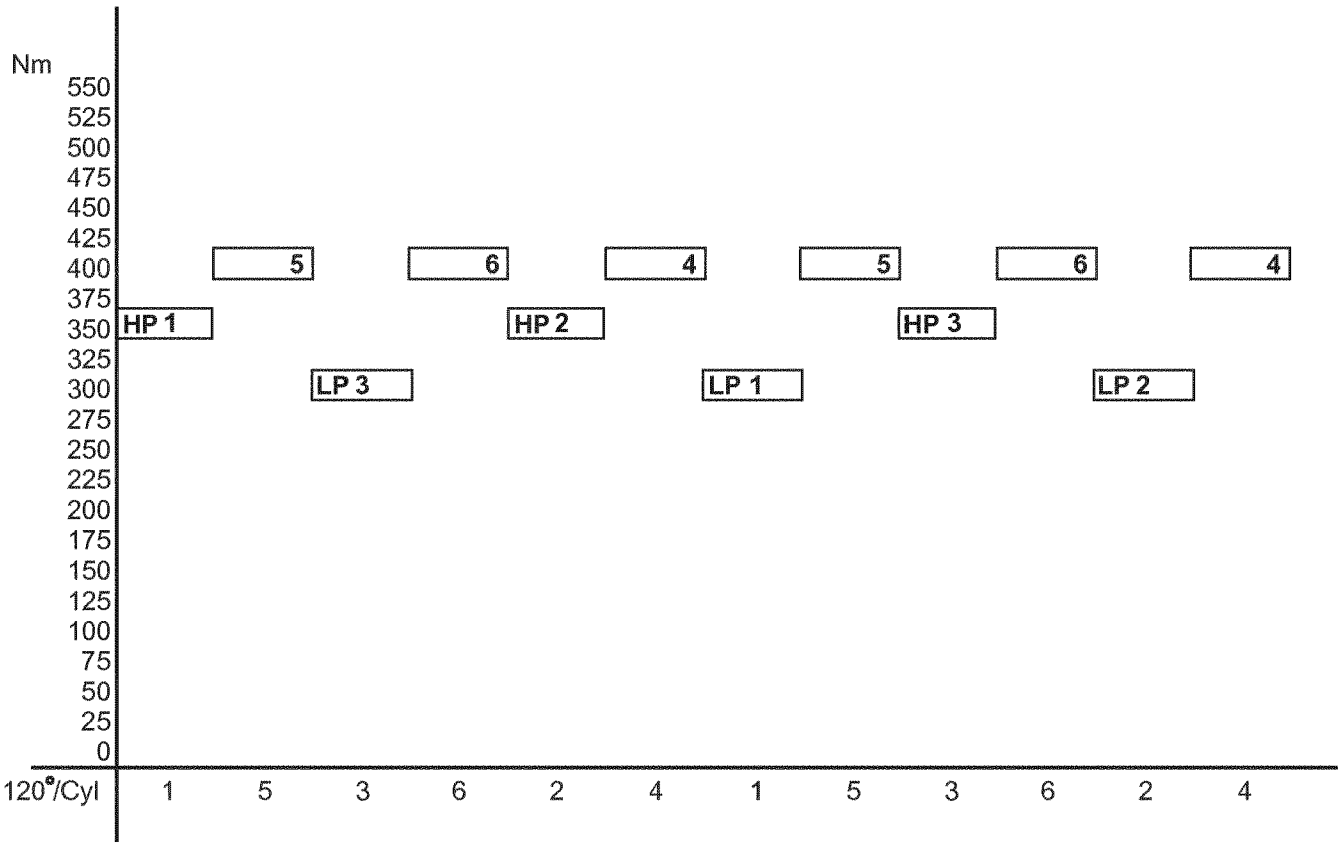
FIG. 5A shows a schematic diagram illustrating engine operation for regenerating a DPF unit at low heat.

FIG. 5A shows a schematic diagram illustrating engine operation for regenerating a DPF unit at low heat. As described above, the ECU can detect an elevated pressure difference across the DPF unit, indicating that regeneration is required. The ECU will then activate a regeneration process to increase the DPF temperature to a desired level when accumulated particulates are burnt off.

The current example relates to a V6-engine having two banks of cylinders where the respective banks are numbered 1-3 and 4-6 in consecutive order, as shown in FIG. 2. The firing order for this engine is 1-5-3-6-2-4. After detecting that the engine is operated at low load, in this case just above idling, the ECU has detected that the DPF unit is outside its desired operating parameters, but that the exhaust temperature is insufficient for regeneration. While monitoring that the vehicle is operated at low load, the ECU calculates a target exhaust temperature and selects a group of cylinders based on stored values, a look-up table or similar. In this example, three out of six cylinders in the V6-engine are used, wherein cylinders 1, 2 and 3 are regulated while cylinders 4, 5 and 6 are operated normally at the currently requested load, i.e. idling. The ECU will then control the ICE by controlling the $1^{st}$ and $2^{nd}$ fuel amounts until the elevated target exhaust temperature is achieved. This is illustrated in FIG. 5A, where the firing order is shown on the x-axis and the output torque (Nm) is shown on the y-axis. Consequently, the regulated cylinders 1, 2 and 3 are operated so that the calculated $1^{st}$ and $2^{nd}$ fuel amounts are injected alternately in consecutive induction strokes for the selected group of cylinders to achieve the target exhaust temperature. In this case, the increased $1^{st}$ fuel amount would be injected in cylinder 1, while the reduced $2^{nd}$ fuel amount would be injected in cylinder 2. The subsequent increased $1^{st}$ fuel amount would be injected in cylinder 3, while the subsequent reduced $2^{nd}$ fuel amount would be injected in cylinder 1, and so on. Hence, the distribution of the increased and the decreased fuel amounts will follow the firing order of the regulated cylinders 1-3.

From FIG. 5A it can be seen that the current fuel balance is approximately 80/20, wherein the increased $1^{st}$ fuel amount produces a power output of 350 Nm per combustion stroke while the $2^{nd}$ fuel amount produces a power output of 300 Nm per combustion stroke. The non-regulated cylinders 4, 5 and 6 are controlled to maintain engine operation at the requested low load. The reduction in torque output from cylinders 1-3 requires an increase of the fuel injection to cylinders 4-6 from the initially requested torque, so that each produces a power output of 400 Nm per combustion stroke. The ICE is controlled in this way until the target exhaust temperature for regenerating the DPF unit is achieved or until it is detected that low load operation is interrupted.

If necessary due to e.g. low ambient temperatures, the ICE can adjust the exhaust temperature by controlling the $1^{st}$ and $2^{nd}$ fuel amounts up or down to achieve the target exhaust temperature. If the ECU detects that the target exhaust temperature cannot be achieved at the maximum ratio for the $1^{st}$ and $2^{nd}$ fuel amounts, then the number of cylinders in the selected group is increased.

Figure 5B:
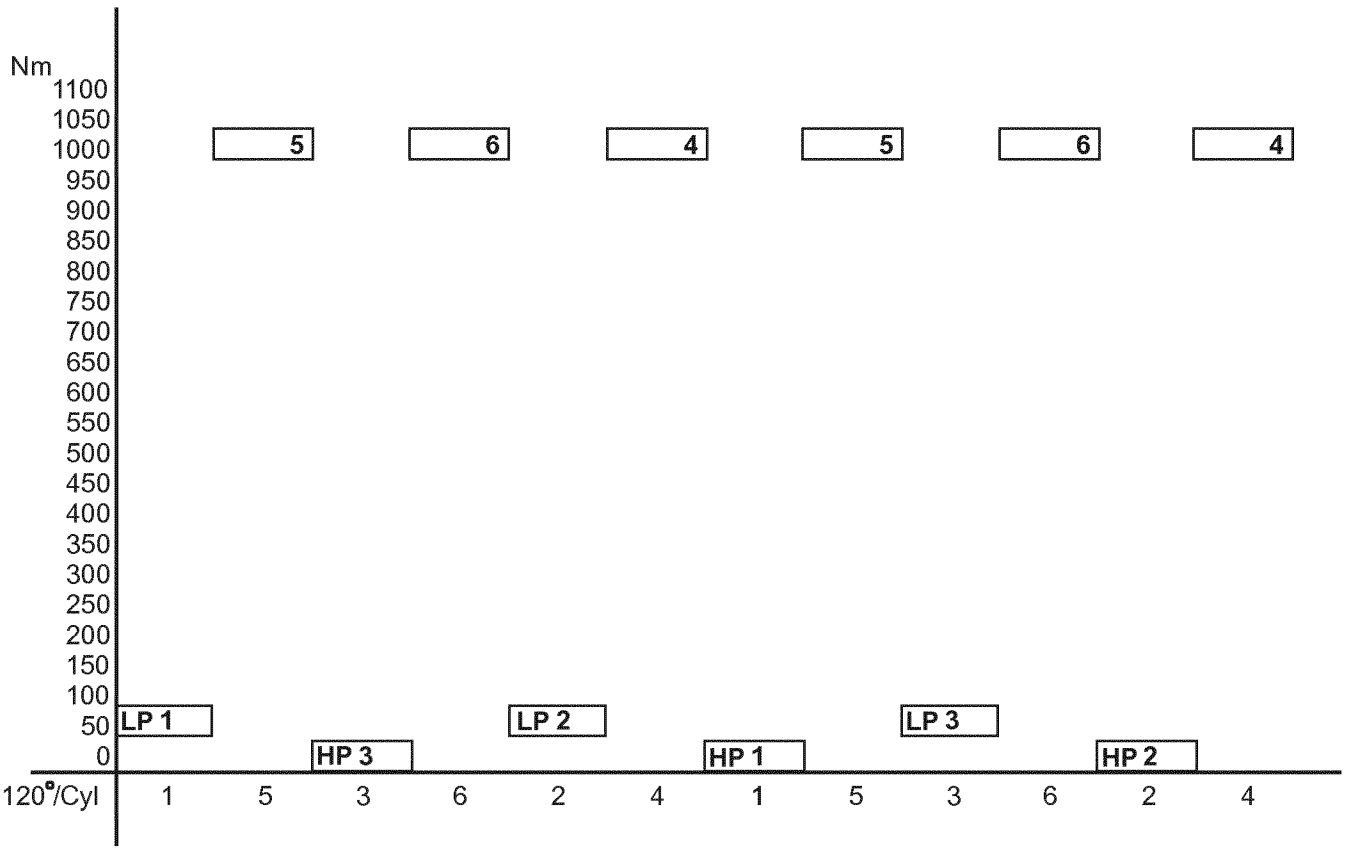
FIG. 5B shows a schematic diagram illustrating engine operation for regenerating a DPF unit at high heat.

FIG. 5B shows a schematic diagram illustrating engine operation for regenerating a DPF unit at high heat. In this example, the ECU has adjusted the injected fuel amounts to cause an increase of the DPF temperature to a level sufficient for activating the regeneration process.

From FIG. 5B it can be seen that the current fuel balance is adjusted to 100/0, wherein the increased $1^{st}$ fuel amount produces a power output of 25 Nm per combustion stroke while the $2^{nd}$ fuel amount is reduced to zero. The non-regulated cylinders 4, 5 and 6 are controlled to maintain engine operation at the requested low load. The reduction in torque output from cylinders 1-3 requires an increase of the fuel injection to cylinders 4-6, so that each produces a power output of 1000 Nm per combustion stroke. The ICE is controlled in this way until the target exhaust temperature for regenerating the DPF unit is achieved or until it is detected that low load operation is interrupted.

If necessary due to e.g. low ambient temperatures, the ICE can adjust the exhaust temperature by controlling the $1^{st}$ and $2^{nd}$ fuel amounts up or down to achieve the target exhaust temperature. If the ECU detects that the target exhaust temperature cannot be achieved at the maximum ratio for the $1^{st}$ and $2^{nd}$ fuel amounts, then the number of cylinders in the selected group is increased.

Figure 6:
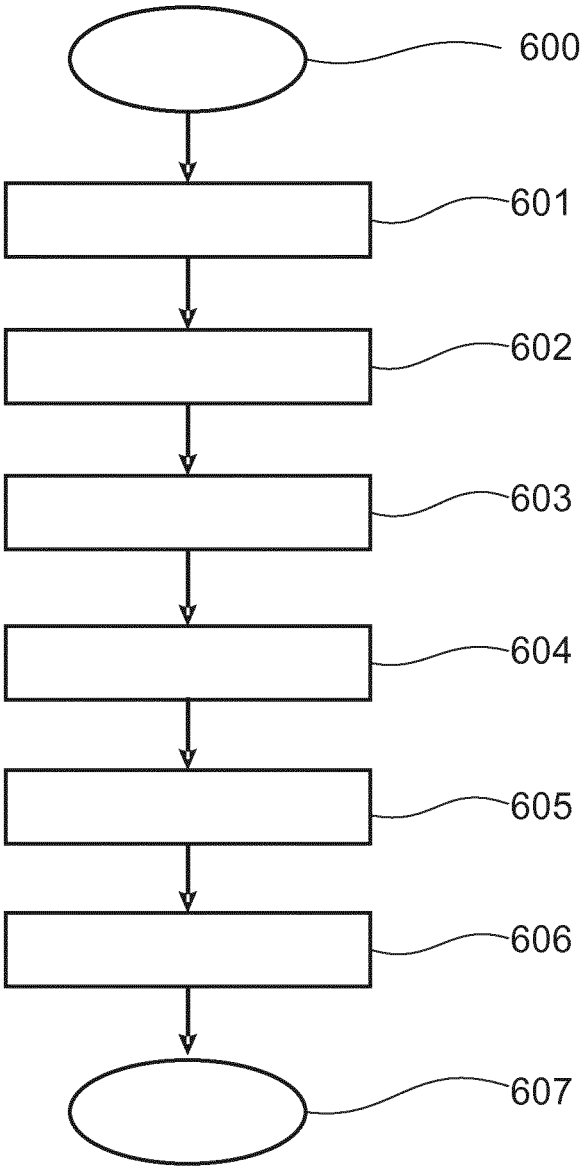
FIG. 6 shows a diagram of a process for performing method.

FIG. 6 shows a diagram of a process for performing method. As can be seen in FIG. 6, the process is initiated by the ECU at step 600. In a first step 601, the ECU registers low load operation of the ICE. In a second step 602 the ECU registers an input from at least one EATS sensor indicating a detected predetermined condition, such a low SCR temperature or a clogged DPF unit. In a third step 603 the ECU determines an exhaust temperature requirement for the detected condition and calculates a target exhaust temperature. In a fourth step 604 the ECU selects a group of cylinders to be regulated for achieving the target exhaust temperature. In a fifth step 605 the ECU calculates a ratio for desired $1^{st}$ and $2^{nd}$ fuel amounts to be injected alternately in consecutive induction strokes for the selected group of cylinders and controls the ICE to achieve the target exhaust temperature. According to the process, the ratio defines an offset between an increased $1^{st}$ fuel amount to be injected in a cylinder of the selected group of cylinders for every second induction stroke, and a reduced $2^{nd}$ fuel amount to be injected for the intermediate induction strokes. In a sixth step 606 the ECU controls ICE until the target exhaust temperature is achieved or until it is detected that low load operation is interrupted. In this case, the process is ended at step 607.

Figure 7:
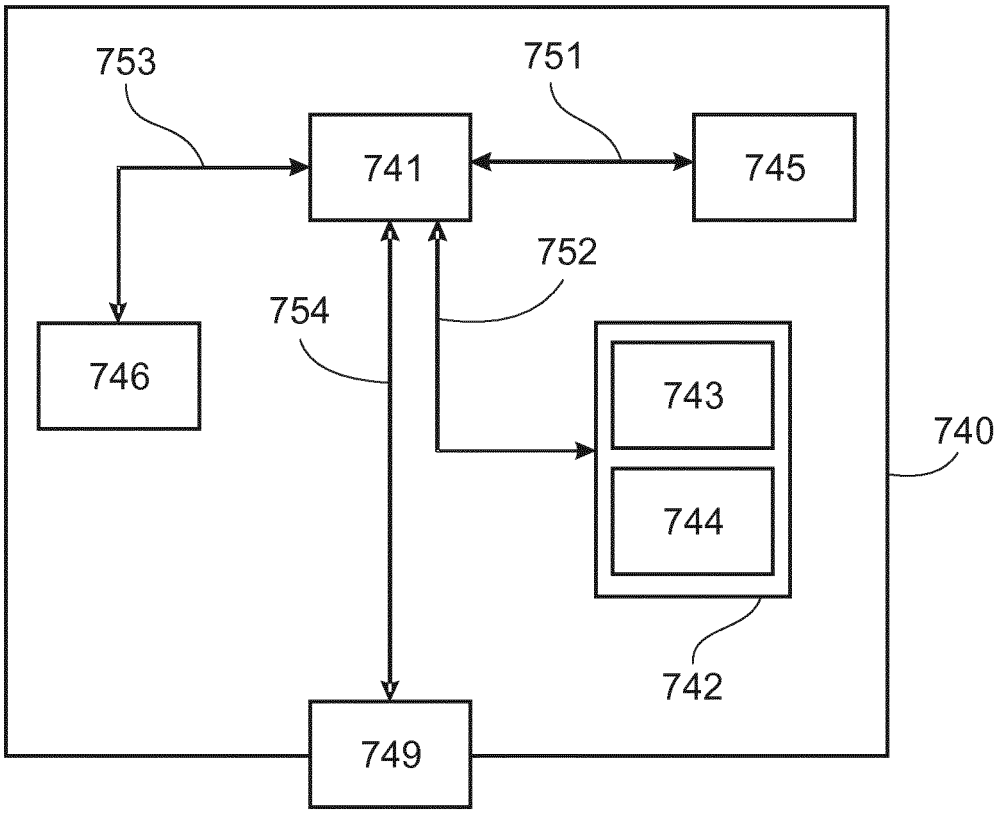
FIG. 7 shows a schematic layout of a computer system for implementing the method according to the invention.

The present disclosure also relates to a computer program, computer program product and a storage medium for a computer all to be used with a computer for executing said method. FIG. 7 shows a schematic layout of a computer system 700 for implementing the method of the disclosure, comprising a non-volatile memory 742, a processor 741 and a read and write memory 746. The memory 742 has a first memory part 743, in which a computer program for controlling the system 700 is stored. The computer program in the memory part 743 for controlling the system 700 can be an operating system. The system 700 can be enclosed in, for example, a control unit, such as a data-processing unit 741. The data-processing unit 741 can comprise, for example, a microcomputer.

The memory 742 also has a second memory part 744, in which a program for measuring torque and other engine related parameters according to the invention is stored. In an alternative embodiment, the program for measuring engine related parameters is stored in a separate non-volatile storage medium 745 for data, such as, for example, a CD or an exchangeable semiconductor memory. The program can be stored in an executable form or in a compressed state. When it is stated below that the data-processing unit 741 runs a specific function, it should be clear that the data-processing unit 741 is running a specific part of the program stored in the memory 744 or a specific part of the program stored in the non-volatile storage medium 745.

The data-processing unit 741 is tailored for communication with the storage memory 745 through a data bus 751. The data-processing unit 741 is also tailored for communication with the memory 742 through a data bus 752. In addition, the data-processing unit 741 is tailored for communication with the memory 746 through a data bus 753. The data-processing unit 741 is also tailored for communication with a data port 748 by the use of a data bus 754. The method according to the present invention can be executed by the data-processing unit 741, by the data-processing unit 741 running the program stored in the memory 744 or the program stored in the non-volatile storage medium 745.

Reference signs mentioned in the claims should not be seen as limiting the extent of the matter protected by the claims. Their sole function is to make claims easier to understand. It is to be understood that the present invention is not limited to the embodiments described above and illustrated in the drawings; rather, the skilled person will recognize that many changes and modifications may be made within the scope of the appended claims.

The invention claimed is:

1. Method to heat exhaust gases to a selected specific temperature by fuel injection control in an internal combustion engine operated in a four stroke cycle, which ICE comprises a control unit registering the currently requested load and determining a required fuel amount in response to the requested load, performing the steps of:

registering low load operation of the internal combustion engine;

registering an input from at least one exhaust after-treatment system sensor indicating a detected condition;

determining an exhaust temperature requirement for the detected condition and calculating a target exhaust temperature;

selecting from a total number of cylinders, a group of cylinders to be regulated for achieving the target exhaust temperature, the group of cylinders being less than the total number of cylinders;

calculating a ratio for desired $1^{st}$ and $2^{nd}$ fuel amounts to be injected alternately in consecutive induction strokes for the selected group of cylinders to achieve the target exhaust temperature; wherein the ratio defines an offset between an increased $1^{st}$ fuel amount to be injected in a cylinder of the selected group of cylinders for every second induction stroke, and a reduced $2^{nd}$ fuel amount to be injected for the intermediate induction strokes, and, monitoring the exhaust temperature and adjusting the number of the group of cylinders to be regulated for achieving the target exhaust temperature.

2. Method according to claim 1, further comprising monitoring the exhaust temperature and adjusting the ratio for desired $1^{st}$ and $2^{nd}$ fuel amounts to be injected in order to achieve the target exhaust temperature.

3. Method according to claim 1, wherein the consecutive induction strokes for the group of cylinders occur in the firing order of the ICE.

4. Method according to claim 1, wherein an increase of the $1^{st}$ fuel amount is balanced by a corresponding reduction of the $2^{nd}$ fuel amount.

5. Method according to claim 4, wherein the $1^{st}$ fuel amount is increased to an amount in excess of the combined $1^{st}$ amount and $2^{nd}$ fuel amount when the $2^{nd}$ fuel amount is reduced to zero.

6. Method according to claim 4, wherein the 1st fuel amount is increased up to 130% of the combined $1^{st}$ amount and $2^{nd}$ fuel amount when the $2^{nd}$ fuel amount is reduced to zero.

7. Method according to claim 1, wherein the ratio for the desired $1^{st}$ and 2nd fuel amounts increases with an increased exhaust temperature requirement.

8. Method according to claim 1, further comprising registering low load operation using an idle signal or a signal indicating low driving torque request.

9. Method according to claim 1, wherein at least one remaining, non-selected cylinder are operated by injecting the required fuel amount for the requested load.

10. Method according to claim 1, wherein at least one remaining, non-selected cylinder are operated in response to a currently requested load determined by the control unit.

11. Method according to claim 1, wherein the group of cylinders comprise up to and including half the total number of cylinders.

12. Control system to heat exhaust gases to a selected specific temperature by fuel injection control wherein the control system is operated using the method according to claim 1.

13. A computer program comprising program code for performing all the steps of claim 1 when said program code is run on a computer.

14. A non-transitory computer program product comprising program code stored on a computer readable medium for performing all steps of claim 1 when said program code is run on a computer.

* * * * *